United States Patent [19]

Hatch

[11] Patent Number: 4,738,296

[45] Date of Patent: Apr. 19, 1988

[54] ROLLING STEEL DOOR

[75] Inventor: Bernard Hatch, 960 W. Brooks St., Ontario, Calif. 91761

[73] Assignees: Bernard E. Hatch; Marcilyn J. Hatch, both of Ontario, Calif.

[21] Appl. No.: 907,081

[22] Filed: Sep. 15, 1986

[51] Int. Cl.[4] ..... E06B 9/14

[52] U.S. Cl. ..... 160/133; 160/315

[58] Field of Search ..... 160/133, 23 R, 315, 160/263

[56] References Cited

U.S. PATENT DOCUMENTS

| | | | |
|---|---|---|---|
| 1,408,605 | 3/1922 | Kehres | 160/263 |
| 2,307,095 | 1/1943 | Zaferakis | 160/263 |
| 2,350,287 | 5/1944 | Michelman | 160/133 |
| 2,520,618 | 8/1950 | Winter | 160/315 |
| 2,696,250 | 12/1954 | Michelman | 160/315 |
| 3,172,461 | 3/1965 | Langer | 160/133 |
| 3,640,332 | 2/1972 | Luby et al. | 160/133 |
| 3,734,161 | 5/1973 | Pierce | 160/40 X |
| 3,842,892 | 10/1974 | Stieler | 160/133 |
| 3,989,084 | 11/1976 | Inamura et al. | 160/133 X |
| 4,037,639 | 7/1977 | Jones | 160/133 |

*Primary Examiner*—Ramon S. Britts
*Assistant Examiner*—David M. Purol
*Attorney, Agent, or Firm*—Edgar W. Averill, Jr.

[57] ABSTRACT

An improved rolling steel door of the type having interlocking steel slats, each slat being hinged to the slat above and below it. An improved method of holding the slats in vertical alignment with one another utilizes a pin affixed to the lower end of each slat. The pin has an enlarged head which abuts the edge of the adjacent slat. A spring module is readily removable from the rolling steel door assembly to facilitate the replacement of a broken or inoperative spring.

5 Claims, 2 Drawing Sheets

ROLLING STEEL DOOR

BACKGROUND OF THE DISCLOSURE

The field of the invention is steel doors and the invention relates more particularly to commercial rolling doors which are held by a barrel at the upper end thereof and are opened by rolling the same up on the barrel. Such doors are fabricated from a plurality of steel slats, each slat having an upper curved channel which surrounds the lower curved portion of the adjacent superior slat.

Typically, such slats are held together by end locks riveted to alternate slats. Such end locks are riveted to the central portion of each slat and extend both upwardly to cover the intersection at the top of the slat to which it is riveted and downwardly to extend past the intersection of the lower end of the slat to which it is riveted. In this manner, the slats cannot be moved horizontally with repsect to each other because the lower end portion of one slat will abut the end lock which is riveted to the slat below it. Similarly, the upper end of the slat will abut the end lock which is riveted to the slat above it. The end locks ride in a channel and are capable of guiding the rolling door within the channel.

Such end locks have several shortcomings. Firstly, they are relatively large and add unnecessarily to the weight of the door. Secondly, they are labor-intensive to install in that holes must be punched or drilled in each slat to which they are affixed and the rivets or bolts pass through such holes into the end locks. Furthermore, since such end locks are typically made of cast iron, they tend to wear against the channels in which they ride. Such wear can form a groove into the channel and sometimes wear completely through the channel.

Another feature of typical rolling doors is a barrel to which the top of the door is affixed. This barrel surrounds a counter-balancing torsion spring which has a finite life. When the spring breaks or becomes detached at either end, it must be serviced. Such service is very labor-intensive, requiring many hours of cutting and welding on the job to accomplish.

SUMMARY OF THE INVENTION

It is an ojbect of the present invention to provide a rolling steel door having end pieces which are easier to install and of less weight.

Another object of the present invention is to provide a counterbalance spring which may be easily replaced in the field.

The present invention is for an improved rolling steel door of the type having a plurality of interlocking steel slats, each such slat having an upper curved channel which surrounds the lower curved portion of the adjacent superior channel and a lower curved portion which holds the upper curved channel of the inferior slat, said plurality of slats forming a curtain supported at the upper edge by a rotatable barrel. The curtain is supported along each side by a vertical channel so that the turning of the rotatable barrel is capable of raising and lowering the curtain. The improvement comprises a lower curved portion on each slat which forms an essentially closed cylinder and an end plug held by the interior surface of each of said esentially closed cylinders. Each of said end plugs extends outwardly at the edge of said slat an amount sufficient to contact the edge of the curved channel of each adjacent channel whereby the channels are prevented from sliding laterally with respect to each other. A preferred barrel assembly has an outer cylinder to which the rolling steel door is affixed, and the barrel assembly also has an inner-spring-containing assembly which is readily removable from the outer cylinder whereby the spring assembly may be replaced with a minimum of disassembling of the door. In this way, the spring assembly can be serviced in a remote location having appropriate tools therefor, and a minimum of time is necessary on the job site.

DESCRIPTION OF THE PREFERRED EMBODIMENTS

Figure 1:
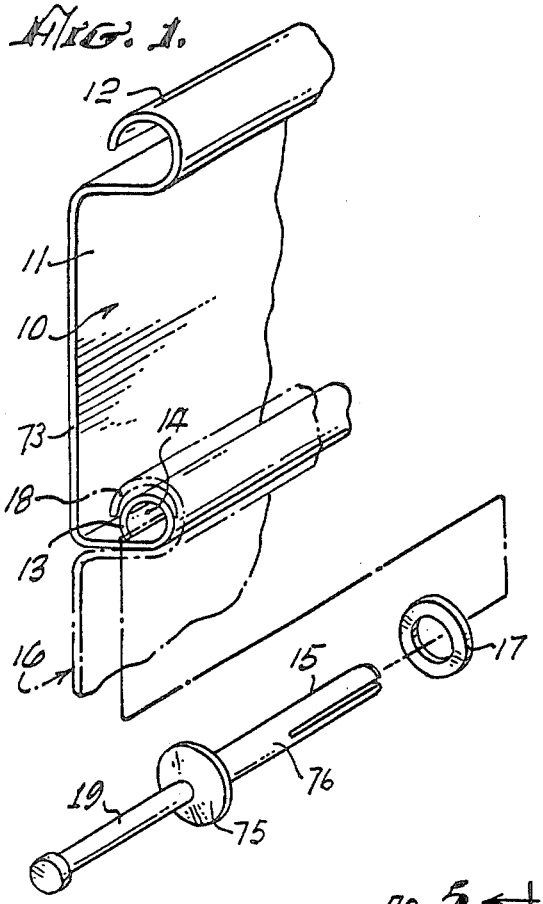
FIG. 1 is an exploded perspective view of an end of one slat showing the end plug affixable thereto and showing a lower slat in phantom view.

One end of an interlocking steel slat is shown in perspective view in FIG. 1 and indicated generally by reference character 10. Slat 10 has a first end 73, a second end 74, a central web 11 terminating at its upper end in a curved channel 12. A lower curved portion 13 forms an essentially closed cylinder having an inner surface 14 into which an end plug 15 having an elongated shank 76 is inserted after the slat 10 has been joined to a lower, or inferior, slat 16 shown in phantom lines in FIG. 1. A washer 17 is preferably used to provide a bearing surface against which the rivet head 75 and the face 18 of slat 16 may touch.

Figure 2:
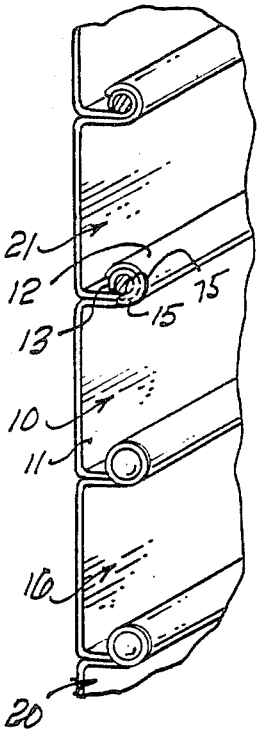
FIG. 2 is a perspective view of a plurality of the slats of FIG. 1 interconnected.

A plurality of slats is joined, as shown in FIG. 2, by sliding the lower curved portion of each slat into the curved channel of its adjacent slat. In FIG. 2, slat 10 is joined to slat 21 above it and slats 16 and 20 below it. Thus, every slat, such as slat 10, has a superior slat, such as slat 21, and an inferior slat, such as slat 16, except for the top slat 71 which has no superior slat and the bottom slat 72 which has no inferior slat. After the slats have been so joined, end plug, such as end plug 15, may be inserted to complete the assembly. End plug 15, as shown in FIG. 1, is an expandabe rivet which has a head 75, a central drive pin 19 which is struck to expand the elongated shank 76 of the end plug against the inner surface 14. End plug 15 of FIG. 1 is an expandable rivet.

Figure 3:
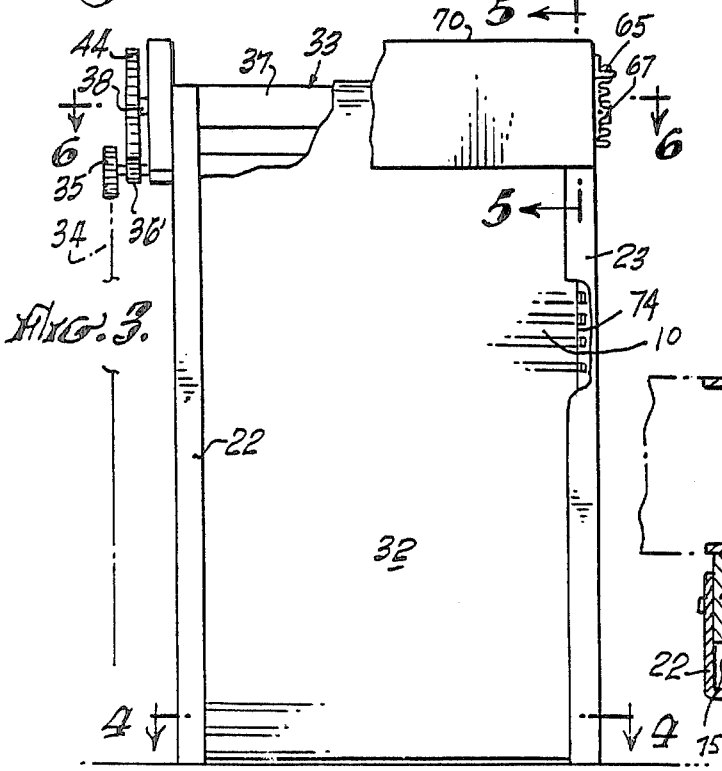
FIG. 3 is a plan view of a rolling steel door assembly of the present invention.
Figure 5:
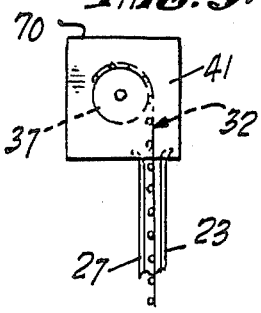
FIG. 5 is an end view taken along line 5—5 of FIG. 3.
Figure 4:
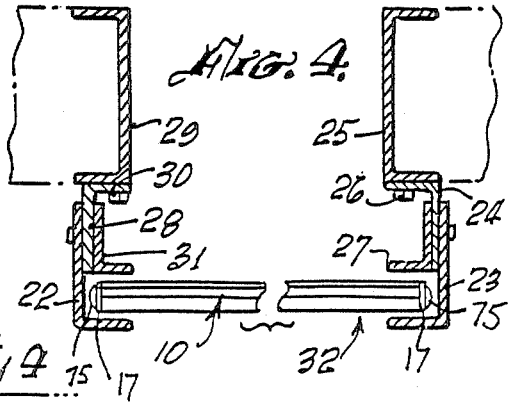
FIG. 4 is an enlarged cross-sectional view along line 4—4 of FIG. 3.

The entire rolling door assembly is shown in FIG. 3 where a pair of guides are indicated by reference characters 22 and 23, and the details of assembly of a typical guide are shown in FIG. 4. There, guide 23 is welded to angle iron 24 which is affixed to door jamb 25 by bolts 26. A second smaller angle-iron 27 completes the guide channel. Similarly, guide 22 is welded to angle-iron 28 and bolted to jamb 29 by bolt 30. Second angle-iron 31 completes the formation of the channel which holds slats, such as slat 10, and provides sufficient space for end plugs 15 which are affixed to each lower curved portion of each slat.

The rolling steel door is indicated generally by reference character 32 in FIG. 3. Door 32 is, of course, made up of a plurality of slats such as interlocking steel slat 10. The door is raised by being rolled up on a cylinder 37 to which the door is bolted in a conventional manner. Cylinder 37 is turned by pulling on a chain 34 which turns a sprocket 35 which is attached to the same shaft as a small gear 36' which turns gear 44 which, in turn, is attached to the central shaft 38, shown in further detail in FIG. 6. In order to facilitate a raising and lowering of larger doors, a counterbalance spring 61 is typically used. For smaller doors such spring is not necessary, but for most commercial doors, such spring is appropriate to counter balance the weight of the door.

Figure 6:
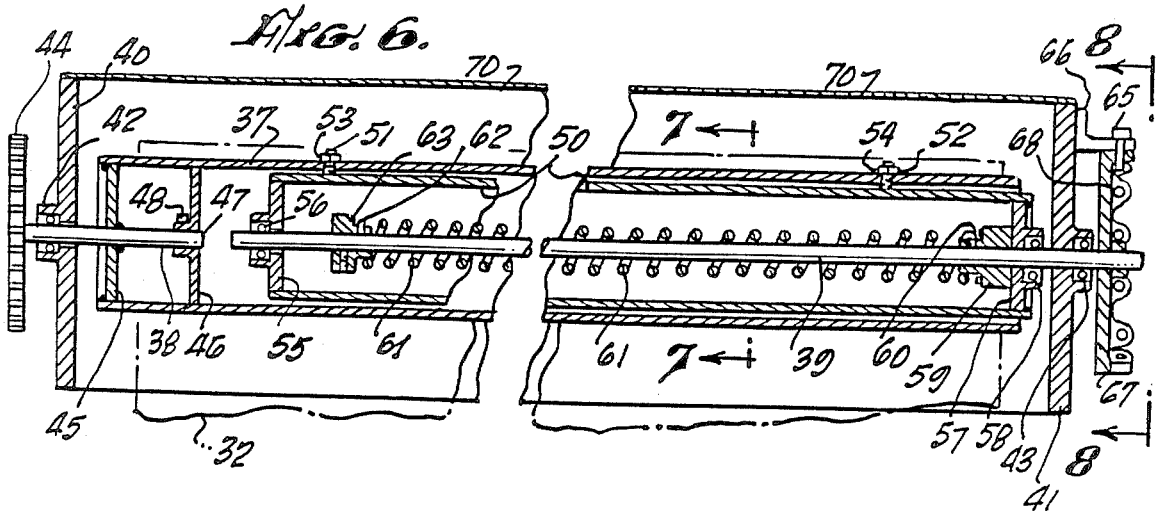
FIG. 6 is an enlarged top view, partly in cross section, of the spring assembly of the door of FIG. 3.
Figure 7:
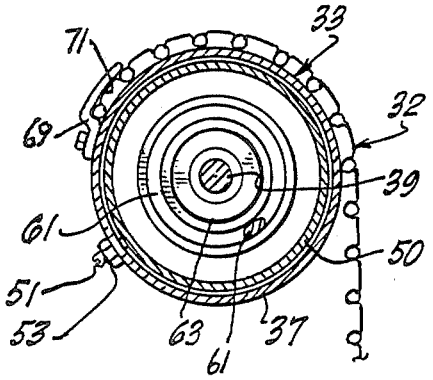
FIG. 7 is a cross-sectional view taken along line 7—7 of FIG. 3.

As shown in FIGS. 6 and 7, door 32 is held to an outer cylinder 37 by clamps 69. Outer cylinder 37 is supported by shafts 38 and 39, which shafts are, in turn, held by end plates 40 and 41 through bearings 42 and 43. End plates 40 and 41 are bolted to the structural wall in a conventional manner.

Shaft 38 supports gear 44 which, in turn, is moved by gear 36 as described above in order to open and close the door. Gear 44 is affixed to shaft 38 which, in turn, is affixed to outer cylinder 37 through a welded plate 45 and a free plate 46 which is secured to the inner end 47 of shaft 38 by a bolt 48. Outer cylinder 37 is, in turn, supported over an inner cylinder 50 which is secured to outer cylinder 37 by a plurality of set screws such as set screws 51 and 52 held to outer cylinder 37 by nuts 53 and 54. Inner cylinder 50 extends the majority of the length of outer cylinder 37. Inner cylinder 50 has an outside diameter only slightly smaller than the inside diameter of outer cylinder 37. This difference may be as little as one-eighth of an inch and is merely enough so that the inner cylinder may be slid into the outer cylinder without binding, but since the two cylinders do not need to move with respect to one another in operation, they may have a relatively snug fit. Shaft 39 rotates freely within inner cylinder 50 and is held to an inner end plate 55 by a bearing 56 and to outer end plate 57 by a bearing 58. A spring anchor 59 is also bolted to the inner surface of outer end plate 57 and supports the outer end 60 of spring 61. Spring 61 is held at its inner end 62 by an anchor 63 which is secured to shaft 39 by a plurality of set screws 64.

In order to provide a counterbalancing force to assist in lifting door 32, the assembly is tightened as shown in FIG. 6 and pin 65 held in arm 66 is removed. Adjusting wheel 67, affixed to the exterior end of shaft 39, is then turned until door 32 begins to raise. Then adjusting wheel 67 is turned back several notches and pin 65 is inserted through an appropriate hole 68 in adjusting wheel 67.

It can be seen that the turning of adjusting wheel 67 tightens spring 61 through its anchor 63. This causes a turning force through anchor 59 on inner cylinder 50 which, in turn, is transmitted to outer cylinder 37 and through clamps 69 to door 32. Thus, as one causes gear 44 to turn, the lifting of door 32 is facilitated by the tension present in spring 61. The entire assembly is covered with a sheet metal cover plate 70.

To service the spring, rather than having to completely disassemble the counterbalancing spring assembly, one need merely loosen set screws 51 and 52 and slide the inner cylinder 50 with its contained spring and anchors and replace it with a rebuilt or new inner cylinder assembly, enabling the entire job to be completed in less than an hour. The inner cylinder, with its spring shaft and the like, is then transported to a central shop and disassembled and repaired as necessary, thereby greatly reducing the amount of labor required at the job site. Since appropriate machinery is present in the central shop, this repair job can be done with much greater efficiency than heretofore possible.

Figure 8:
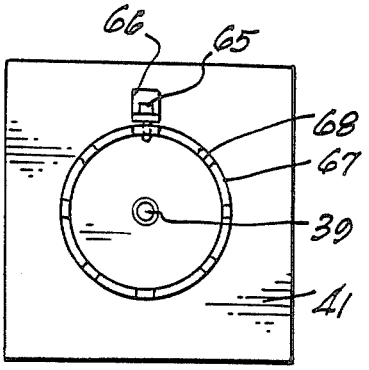
FIG. 8 is an end view taken along line 8—8 of FIG. 6.

The end plate 41 is shown in end view in FIG. 8 where the adjusting wheel 67 can be seen to be circular and of a conventional design.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved rolling steel door of the type having a plurality of interlocking steel slats, each such slat except for a top slat and a bottom slat having an adjacent superior slat and an adjacent inferior slat and a first end and a second end and each such interlocking slat having an upper curved channel and a lower curved portion, the upper curved channel surrounds the lower curved portion of the adjacent superior channel and the lower curved portion thereof holds the upper curved channel of the inferior slat, said plurality of slats forming a curtain supported at the top slat by a spring-tensioned rotatable barrel assembly including a spring assembly and said curtain being supported along each side by a channel so that the turning of the rotatable barrel raises and lowers the curtain wherein the improvement comprises:

said barrel assembly having an outer cylinder to which the rolling steel door is affixed and said outer cylinder having an inner surface and said barrel assembly having an inner spring-containing assembly held within a single inner cylinder having an outside diameter slightly less than the inside diameter of the outer cylinder and having an outer surface which is adjacent the inner surface of the outer cylinder, said inner cylinder extending long a majority of the length of the outer cylinder, said inner cylinder being readily removable from the outer cylinder whereby the spring assembly may be replaced with a minimum of disassembling of the door.

2. The improved rolling steel door of claim 1 wherein said inner spring assembly comprises a steel shaft rotatably held within said inner cylinder by first and second end plates affixed to said inner cylinder;

a first spring anchor affixed to said first end plate, said first spring anchor having a helical torsion spring affixed at its first end to said first spring anchor;

a second spring anchor affixed to the second end of said torsion spring and to said steel shaft, said second spring anchor being held on the shaft between said first and second end plates; and attachment means affixing said outer cylindre to said inner cylinder.

3. The improved rolling steel door of claim 2 wherein said first and second end plates are affixed to said inner cylinder at the ends thereof.

4. The improved rolling steel door of claim 3 wherein said attachment means comprises a plurality of set screws held by said outer cylinder and tightened against said inner cylinder.

5. The improved rolling steel door of claim 4 wherein there are two such set screws.

* * * * *